US006845799B2

(12) United States Patent
Francke et al.

(10) Patent No.: US 6,845,799 B2
(45) Date of Patent: Jan. 25, 2005

(54) DEVICE FOR APPLYING LABELS TO FLAT OBJECTS

(75) Inventors: Jürgen Francke, Berlin (DE); Frank Voss, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/257,180

(22) PCT Filed: Apr. 3, 2001

(86) PCT No.: PCT/DE01/01249

§ 371 (c)(1),
(2), (4) Date: Apr. 24, 2003

(87) PCT Pub. No.: WO01/76950

PCT Pub. Date: Oct. 18, 2001

(65) Prior Publication Data

US 2003/0159784 A1 Aug. 28, 2003

(30) Foreign Application Priority Data

Apr. 10, 2000 (DE) ..... 100 17 770

(51) Int. Cl.[7] ..... B65C 9/00; B65C 9/08; B65C 9/30

(52) U.S. Cl. ..... 156/521; 156/538; 156/539; 156/556; 156/566; 156/568; 156/DIG. 28; 156/DIG. 39

(58) Field of Search ..... 156/350, 352, 156/354, 510, 516, 517, 521, 523, 538, 556, 558, 566, 567, 568, DIG. 1, DIG. 2, DIG. 24, DIG. 28, DIG. 37, DIG. 39, DIG. 40, DIG. 44, DIG. 45

(56) References Cited

U.S. PATENT DOCUMENTS

| | | | | |
|---|---|---|---|---|
| 2,493,737 A | 1/1950 | Burns | ..... | 216/29 |
| 2,555,325 A | 6/1951 | Doane | ..... | 216/30 |
| 2,640,539 A | 6/1953 | Piper | ..... | 164/68 |
| 3,319,499 A | 5/1967 | Hawkes et al. | ..... | 83/99 |
| 3,472,724 A | 10/1969 | Casey | ..... | 156/521 |

(List continued on next page.)

FOREIGN PATENT DOCUMENTS

| | | | | |
|---|---|---|---|---|
| DE | 3622502 A1 | 7/1986 | ..... | B05C/9/14 |
| EP | 0 688 720 A1 | 6/1995 | ..... | B65C/3/06 |
| EP | 0 689 997 A1 | 6/1995 | ..... | B65C/9/44 |

*Primary Examiner*—Sue A. Purvis
(74) *Attorney, Agent, or Firm*—Philip G. Meyers

(57) ABSTRACT

The invention relates to a device that is provided with a pressing and applying drum (17) which is driven during start-stop operation in a controlled manner and is used for applying the labels (16) to flat objects (20) which are transported along a conveying path. The aim of the invention is to transport said objects (20) past the pressing and applying drum. Said drum is provided with a first casing region (23) which receives labels and has a circular bend. The centre of the circle is situated within the rotational axis. The drum is also provided with a second casing region (24). The surface of said second casing region is displaced towards the inside to such an extend that the second casing region (24) cannot touch the objects in a disturbing manner. The two casing regions (23, 24) are connected to one another by means of transition areas (25).

9 Claims, 4 Drawing Sheets

U.S. PATENT DOCUMENTS

Figure 1:
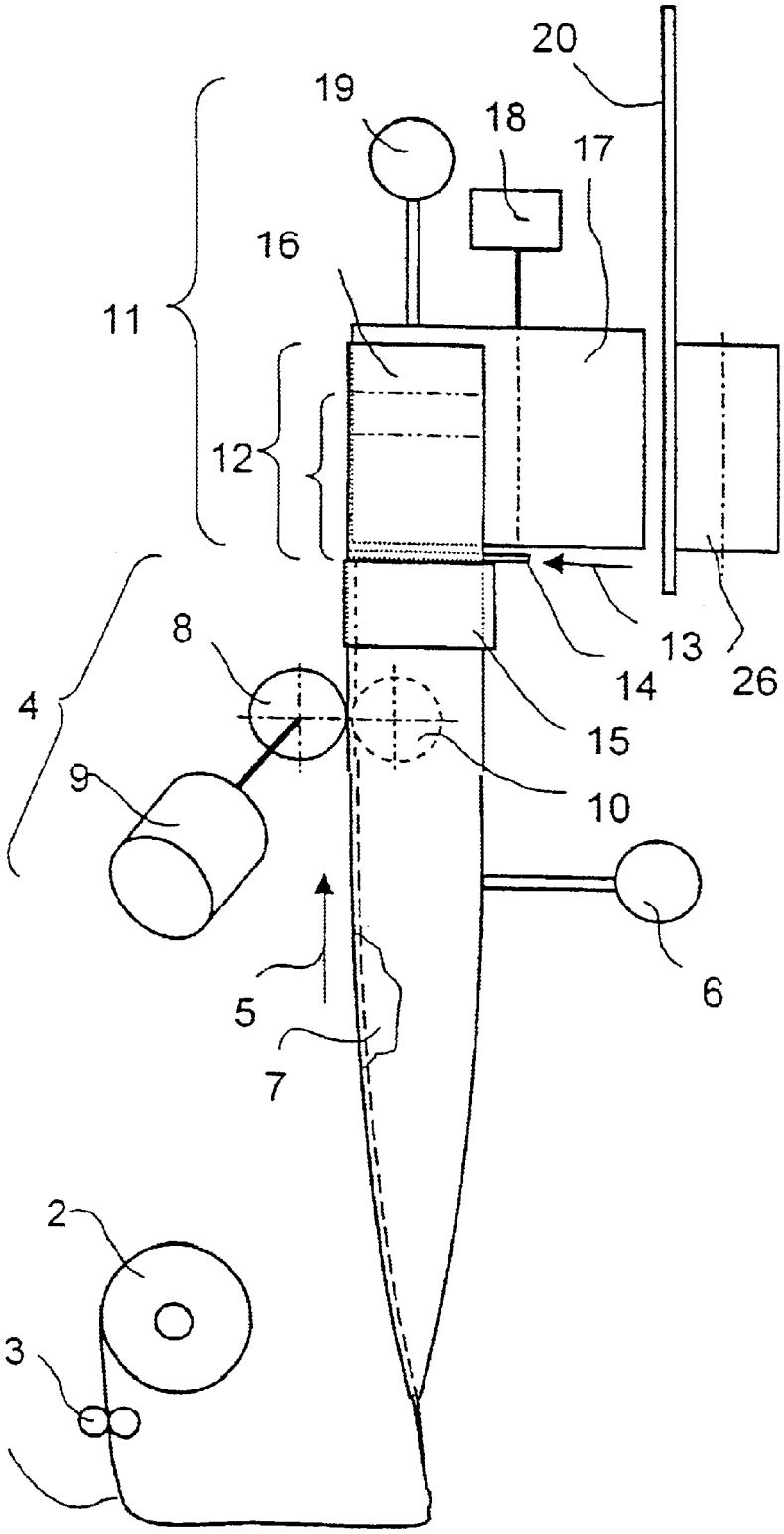

| | | | | | |
|---|---|---|---|---|---|
| 3,660,208 | A | | 5/1972 | Hubbard | 156/571 |
| 3,772,123 | A | | 11/1973 | Clark et al. | 156/357 |
| 3,883,380 | A | | 5/1975 | Kirk et al. | 156/60 |
| 4,029,537 | A | * | 6/1977 | Kish | 156/497 |
| 4,421,587 | A | | 12/1983 | Guenther et al. | 156/256 |
| 4,701,239 | A | | 10/1987 | Craig | 156/519 |
| 4,840,696 | A | | 6/1989 | Krasuski et al. | 156/353 |
| 5,102,485 | A | * | 4/1992 | Keeler et al. | 156/256 |
| 5,200,007 | A | | 4/1993 | Svyatsky | 156/64 |
| 5,294,282 | A | | 3/1994 | Rock et al. | 156/516 |
| 5,531,853 | A | | 7/1996 | Cubow et al. | 156/521 |
| 5,560,293 | A | | 10/1996 | Boreali et al. | 101/288 |
| 5,607,526 | A | | 3/1997 | Buckley | 156/64 |
| 5,674,345 | A | | 10/1997 | Nash | 156/264 |
| 5,783,032 | A | | 7/1998 | O'Callaghan et al. | 156/556 |
| 5,922,169 | A | | 7/1999 | Chodacki et al. | 156/521 |
| 6,006,669 | A | | 12/1999 | Klein et al. | 101/485 |
| 6,383,591 | B1 | * | 5/2002 | Miles et al. | 428/40.1 |

* cited by examiner

DEVICE FOR APPLYING LABELS TO FLAT OBJECTS

The invention relates to an arrangement for applying labels according to the preamble of patent claim 1.

In the case of flat items of mail, in particular letters, postcards, etc., being processed by mail-transporting companies, the task of applying labels reliably and quickly to flat items of mail poses problems. An example of this is the automatic forwarding of items of mail. In this case, items of mail for forwarding are separated out and addressed in accordance with predetermined data which are stored in a database. A label is stuck onto these items of mail and covers both the old address and a barcode which may possibly have been applied to the surface of the items of mail. The label is then provided with a new barcode and the appropriate new address. The label is applied here in arrangements which are integrated in automatic letter-distributing installations. The items of mail arising in such distributing installations differ in terms of format, weight and thickness. The items of mail are conveyed in such installations, for example, at speeds of 3.6 m/sec, which imposes stringent requirements on the speed at which the labels have to be applied and on the precise positioning of the labels. A general problem, furthermore, is constituted by the handling of the labels, and in particular the transportation of the latter to the surface of the items of mail, if the labels have a self-adhesive surface.

U.S. Pat. No. 5,200,007 describes an arrangement for applying labels to flat items of mail which are transported separately, in a state in which they stand on edge, along a conveying path by a conveying arrangement. It has a label-conveying arrangement for conveying the labels, which are located on a substrate, said label-conveying arrangement being controlled by a sensor means for the purpose of determining the leading edge of the items of mail, and also has a pressure-exerting and applying arrangement for applying the labels to, and pressing them onto, the surface of the items of mail. In this arrangement, the labels are printed with distributing information. Labeling at high transporting speeds of the items of mail is not hereby possible.

DE 36 22 502 A1 describes a labeling-head machine in the case of which the labels are retained on the labeling head, which presses the labels onto the article, with the aid of openings in the head surface, said openings being connected to a negative-pressure source.

U.S. Pat. No. 3,660,208 describes a pressure-exerting drum for accommodating a label, in the case of which it is only the label-accommodating part, to which the label is to be applied, which comes into contact with the article, the rest of the drum surface being offset inward. In the case of a pressure-exerting drum according to U.S. Pat. No. 3,883,308, accordingly, two regions are provided for accommodating the labels.

The invention specified in claim 1 is based on the object of providing a means for applying labels to flat articles which ensures a high throughput while having a low level of susceptibility to malfunctioning.

n labeling arrangements, where n>1, for applying labels are arranged one behind the other on the conveying path of the flat articles.

The configuration of the pressure-exerting and applying drums with a spatially fixed axis of rotation, with a first casing region, which accommodates the labels, and with a second casing region, which is offset inward to the extent where it does not come into contact with the flat articles, makes it possible for flat articles to be transported past the pressure-exerting and applying drums without a label being applied to the article.

The pressure-exerting and applying drums are driven in start-stop operation, the label strips being applied to the first casing region, which is directed away from the flat articles, of the pressure-exerting and applying drum. Once a label has been received onto the stationary pressure-exerting and applying drum, and following acceleration and application of the respective label, the pressure-exerting and applying drum is braked such that, following a revolution, the first casing region, directed away from the transporting path of the articles, comes to a standstill in the starting position again.

The labeling arrangements are then activated in accordance with requirements. It is thus possible to apply a plurality of labels to one article or to label every nth article in order to increase the throughput in each arrangement.

In an advantageous configuration, the second casing region has a circular curvature with the same radius of curvature as the first casing region, the only difference being that the center point of its circle is displaced beyond the axis of rotation.

It is advantageous to provide a resilient and/or resiliently mounted mating roller for pressing the labels onto the articles, in particular during transportation of the articles in flexible belts.

The advantageous operation of feeding a self-adhesive, substrate-free label strip perpendicularly to the transporting plane of the flat articles, with curvature adapted to the drum surface, makes it possible to apply labels of different heights, in that the label strip is pushed to different extents onto the pressure-exerting and applying drum and is then severed by the cutter means, which is adapted in curvature.

In an advantageous configuration, the label-conveying and cutting arrangement is formed such that the label strip, which is curved to a slight extent, if at all, at the inlet, merges at the outlet into a curvature which is adapted to the label-receiving surface of the pressure-exerting and applying drum. It is advantageous here for openings which are connected to a negative-pressure source to be introduced into this guide surface for the purpose of retaining the label strip on the guide surface.

It is additionally possible for the guide surface, on its lateral borders, to have narrow top surfaces which retain the label strip on the guide surface even without negative pressure and have an adhesive-repelling face.

In order to prevent the label strip from yielding laterally beyond the guide surface, it has, on its lateral borders, boundary surfaces which direct the label strip.

In a further configuration, located in the guide surface is a through-passage for a friction-wheel drive, comprising a friction wheel with a controlled drive and a pressure-exerting roller, which pushes the label strip onto the pressure-exerting and applying drum to the extent envisaged in each case.

In order to ensure that the label strip runs in an aligned, self-adjusting manner over the guide surface of the label-conveying and cutting arrangement, the friction-wheel drive is advantageously mounted pivotably on a swivel pin which is arranged centrally and perpendicularly to the guide surface, upstream of the friction wheel as seen in the label-feed direction.

Figure 2:
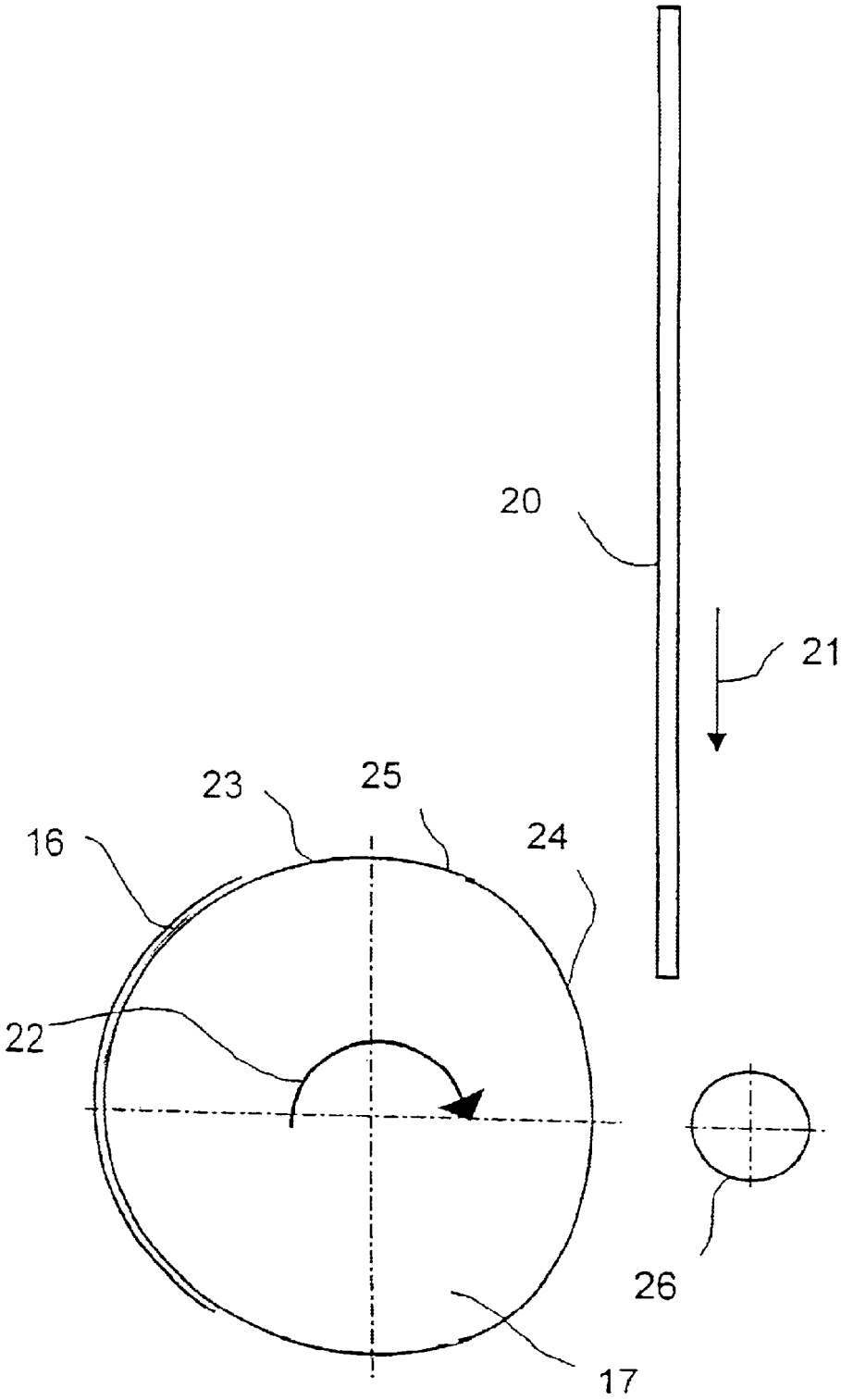
Figure 3:
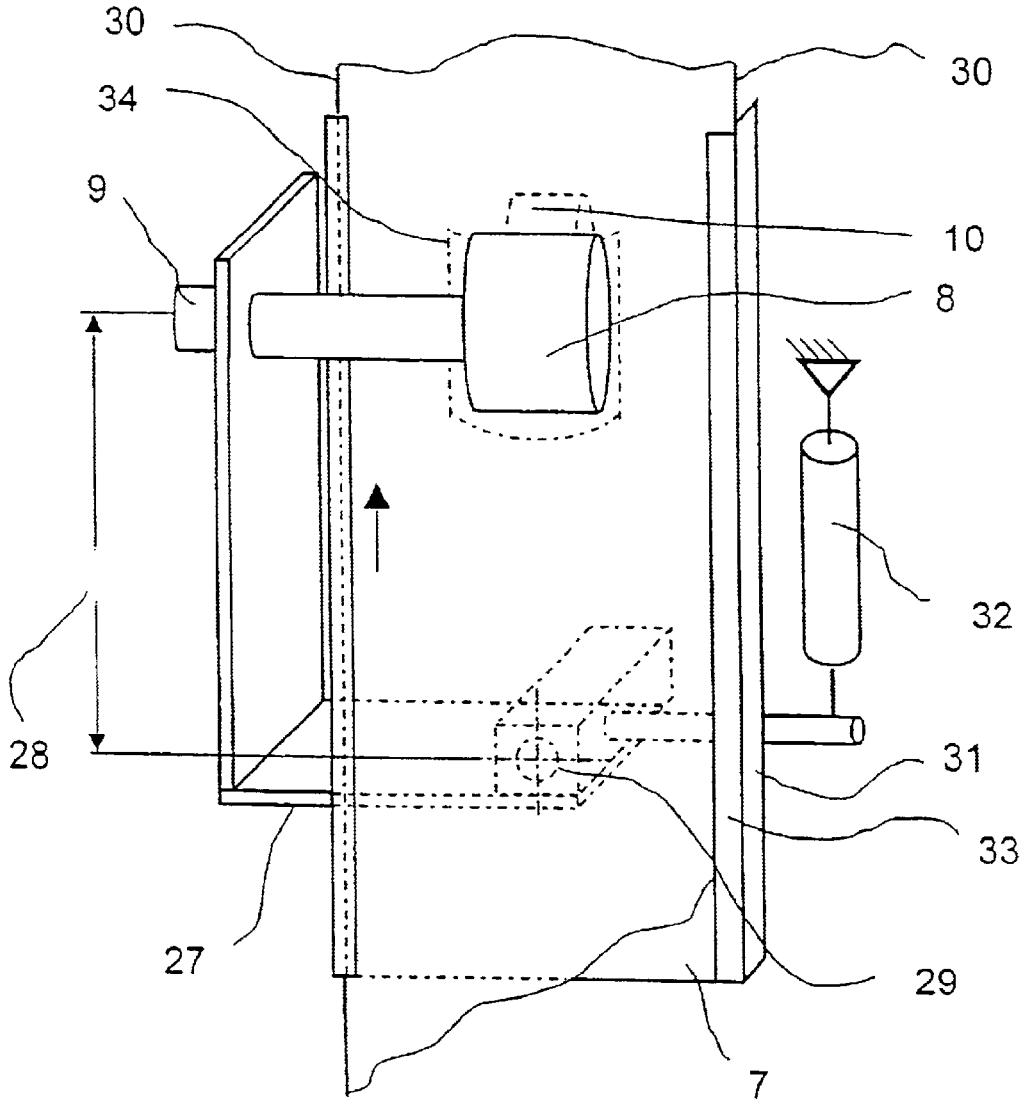
Figure 4:
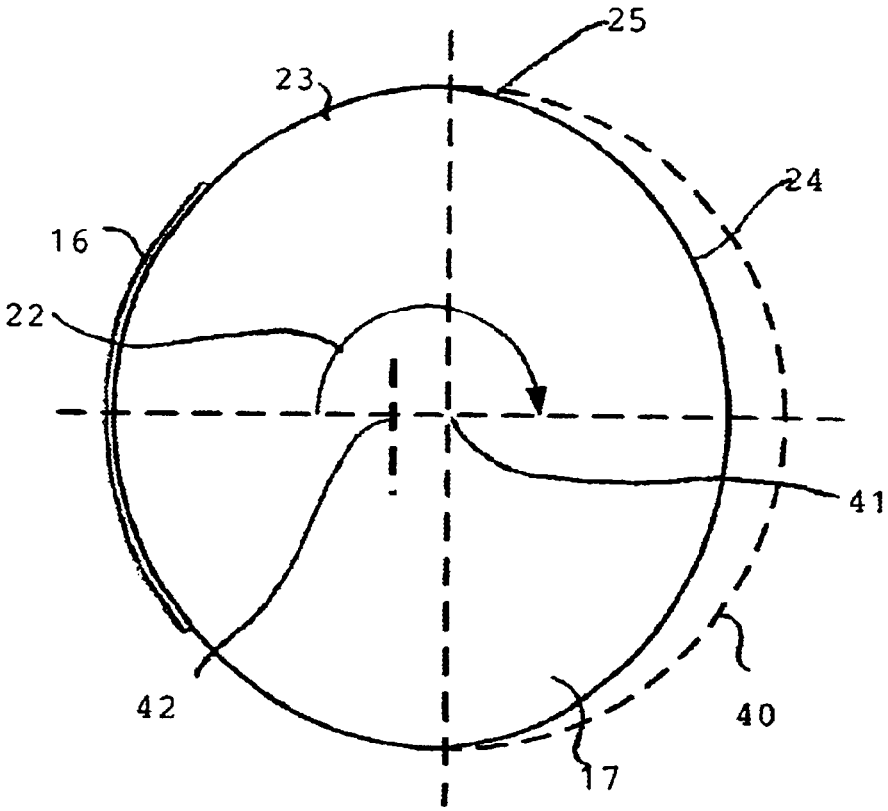

The invention will now be described in more detail by way of an exemplary embodiment and with reference to the drawing, in which:

FIG. 1 shows a schematic side view of the arrangement for applying self-adhesive, substrate-free labels to flat articles, FIG. 2 shows a schematic plan view of the arrangement for applying the labels, FIG. 3 shows a schematic view of the friction-wheel drive and its mounting, and FIG. 4 shows the configuration of the first and second casing regions.

The self-adhesive label strip 1 is drawn off in band form from a supply roll 2, by a label-strip-unrolling means 3 which is known per se, and sent to a label-conveying and cutting arrangement 4.

In the label-conveying and cutting arrangement 4, the label strip 1 is advanced onto a pressure-exerting and applying drum 17, in accordance with the required length, perpendicularly to the transporting plane of the flat articles 20 and is cut off with the pressure-exerting and applying drum 17 at a standstill. For this purpose, the label strip 1 is guided over a shaped guide 7 which, in the label-strip advancement direction 5, merges from a guide surface at the inlet which is curved to a slight extent, if at all, into a guide surface at the outlet which has a curvature which is adapted to the label-accommodating surface of the pressure-exerting and applying drum 17.

Openings which are connected to a negative-pressure source 6 are located in the surface of the guide 7. A motor-controlled friction-wheel drive, comprising a friction wheel 8 with drive 9 and pressure-exerting roller 10, is integrated in the guide 7. The label strip 1 is thus pushed in the direction of the labeling means 11, comprising the pressure-exerting and applying drum 17, which, on the accommodating part, likewise has openings connected to a negative-pressure source 19, and also comprising a drum drive 18 and a resiliently mounted mating roller 26, and is itself transferred into a cylindrical shape.

Once, with the aid of the friction-wheel drive, the label strip 1 has been advanced up to a height 12 above the cutter means, said height being freely determinable within certain limits, the cutter drive 13 moves the cutter 14 over the label strip 1 onto the mating cutter 15 and shears off a label 16. The label 16 is then borne merely by the pressure-exerting and applying drum 17.

On a suitable transporting means (not illustrated), the articles 20 which are to be labeled are guided past the labeling means 11 at a uniform speed 21 along a path on the side which is directed away from the label-conveying and cutting arrangement 4.

During the cutting of the label strip 1, the pressure-exerting and applying drum 17 remains stationary. Thereafter, it is accelerated, with the label 16, to the same speed as the speed 21 of the article 20, measured on the outer surface of the drum. The movement direction 22 is illustrated in figure 2. A control means synchronizes the drum position and speed with the article 20 which is to have a label stuck to it, with the result that, when the part of the pressure-exerting and applying drum 17 with the label 16 arrives at the article path, the self-adhesive label 16 can be received in a specific manner by the article 20. The casing of the pressure-exerting and applying drum 17 is shaped into a first region 23 and a second region 24. The first casing region 23 has a circular curvature the center point of the circle being located on the axis of rotation. In the case of the second casing region 24, the casing surface is displaced inward to such an extent as to avoid disruptive contact with the articles 20 in the rest position. This casing surface may likewise have the same circular curvature as the first casing region 23, the only difference being that the center point of the circle is displaced beyond the axis of rotation. This configuration is illustrated in FIG. 4, where first casing region 23 has circular curvature corresponding to circle 40 with a center 41 located on the axis of rotation of drum 17. Second casing region 24 has an identical circular curvature with a center 42 that is shifted or displaced to the left relative to center 41, toward first casing region 23. The two casing regions 23, 24 are connected by corresponding transition regions 25. On the one hand, this means that the pressure-exerting and applying drum 17 in rest phases, e.g. during label cutting or pauses in the applying operation, cannot project into the article path and the articles 20 or parts thereof thus cannot be influenced thereby. On the other hand, during the applying operation, it is possible to exert a certain uniform pressure against the flat articles in order to transfer the self-adhesive label 16. In order to assist the operation of transferring the labels onto the articles 20, a counterpressure may be produced by the pressure-exerting roller 26 running along therewith.

The motor-controlled friction-wheel drive, comprising the friction wheel 8 with drive 9 and pressure-exerting roller 10, is mounted on a chassis 27 (FIG. 3). The friction wheel 8 and pressure-exerting roller 10 are located in a through-passage 34 of the guide 7. Said chassis 27 is mounted pivotably on a swivel pin 29, which is arranged centrally and perpendicularly to the guide 7, at a certain distance 28 upstream of the friction-wheel drive, as seen in the label-strip advancement direction 5. This achieves the situation where the label strip 5 aligns itself automatically, by way of its longitudinal edges 30, with the boundary surfaces 31 fastened laterally on the guide 7. If for whatever reason, for example, one of the longitudinal edges 30 presses onto one of these boundary surfaces 31, then the intention is for it to be possible for said longitudinal edge 30 to yield laterally by way of a guide force arising. This is made possible by the movable arrangement of the friction-wheel drive on the chassis 27. The lateral displacement of the friction wheel 8 results in the friction-wheel drive being positioned obliquely in relation to the conveying direction, and this causes the friction wheel 8 to roll obliquely over the label strip 1 and the lateral deflection of the chassis 27 thus to be eliminated. The chassis 27 may be influenced in its zero position by the force of a spring 32. Variation of the spring force makes it possible to orient the label strip 1 on one of the two boundary surfaces 31.

In order that the borders of the label strip 1 cannot lift off from the guide 7 even when the negative-pressure source 19 has been switched off, narrow top surfaces 33 with adhesive-repelling faces are provided on the boundary surfaces 31.

What is claimed is:

1. A system for applying labels to flat articles conveyed along a conveying path, comprising:

a plurality of *n* labeling devices where *n* is greater than one, the labeling devices being arranged sequentially along a conveying path such that each *m*th unlabel article, where *m* is greater than or equal to one is labeled, each of the labeling devices comprising a label applying drum, the drum having a spatially fixed axis of rotation and first and second peripheral surfaces;

the first peripheral surface having a circular curvature with a center point located on the axis of rotation of the drum and being adapted to receive and rotate to apply labels moving along the conveying path;

the second peripheral surface having a surface displaced inwardly toward the axis of rotation such that flat articles traveling along the conveying path do not contact the drum when the second peripheral surface is positioned adjacent the conveying path;

means for feeding a continuous strip of labels onto an end of the drum, said means including a guide for conforming the strip to the curvature of the first peripheral surface such that the strip is directed onto the first peripheral surface in a direction parallel to the axis of rotation;

means for cutting a label from a portion of the strip positioned on the first peripheral surface;

means for rotating the drum such that a label carried on the first peripheral surface contacts a flat article traveling along the conveying path such that the label is applied to the article; and means for stopping the drum after the label has been applied to the article with the second peripheral surface positioned adjacent the conveying path and the first peripheral surface positioned adjacent the guide.

2. The system of claim 1, wherein the guide further comprises boundary walls extending along the edges of the guide for guiding the label strip and wherein the means for feeding a continuous strip of labels onto the drum further comprises a friction wheel for advancing the strip, the friction wheel being movable in a direction perpendicular to the guide.

3. The system of claim 2, wherein the means for feeding a continuous strip of labels onto the drum further comprises a roller, the roller being opposed to the friction wheel through a hole in the guide.

4. The system of claim 3, wherein the friction wheel and the roller are mounted on a moveable chassis.

5. The system of claim 3, further comprising a resilient mating roller, the mating roller being positioned in opposed relationship to the drum whereby flat articles are pressed against the drum as a label is applied to the flat article.

6. The system of claim 3, wherein the second peripheral surface has a circular curvature with the same radius of curvature as the first peripheral surface, the second peripheral surface being displaced inwardly toward the axis of rotation.

7. The system of claim 3, further comprising a sensor for detecting the position of a flat article to be labeled.

8. The system of claim 1, wherein m>1.

9. A system for applying labels to flat articles conveyed along a conveying path, comprising:

a plurality of *n* labeling devices where *n* is greater than one, the labeling devices being arranged sequentially along a conveying path such that each *m*th unlabeled article, where *m* is greater than one, is labeled, each of the labeling devices comprising a label applying drum, the drum having an axis of rotation and first and second curved peripheral surfaces;

the first peripheral surface having a circular curvature with a center point located on the axis of rotation of the drum and being adapted to receive and rotate to apply a label to a flat article moving along the conveying path;

the second peripheral surface being offset inwardly toward the axis of rotation such that flat articles traveling along the conveying path do not contact the drum when the second peripheral surface is positioned adjacent the conveying path;

a feeder that advances a continuous strip of labels onto the drum, the feeder including a guide for conforming the strip to the curvature of the first peripheral surface;

a cutter positioned to sever a label from a portion of the strip positioned on the first peripheral surface; and a drive system that rotates the drum such that a label carried on the first peripheral surface contacts a flat article traveling along the conveying path, and stops the drum after the label has been applied to the article with the second peripheral surface positioned adjacent the conveying path and the first peripheral surface positioned adjacent the guide.

* * * * *